US005405208A

United States Patent [19]

Hsieh

[11] Patent Number: 5,405,208

[45] Date of Patent: Apr. 11, 1995

[54] PEN WITH ILLUMINATING FUNCTION

[76] Inventor: Chi L. Hsieh, No. 8, Alley 1, Lane 76, Sec. 2, Li Shyng Road, San Chorng City, Taipei County,

[21] Appl. No.: 277,649

[22] Filed: Jul. 20, 1994

[51] Int. Cl.[6] ..... B43K 29/10

[52] U.S. Cl. ..... 401/195; 362/118

[58] Field of Search ..... 401/195; 362/118

[56] References Cited

U.S. PATENT DOCUMENTS

| | | | |
|---|---|---|---|
| 1,722,238 | 7/1929 | Weber | 362/118 |
| 2,052,501 | 8/1936 | Thornton | 362/118 |
| 5,143,465 | 9/1992 | Hou | 401/195 |

FOREIGN PATENT DOCUMENTS

| | | | |
|---|---|---|---|
| 967245 | 8/1964 | United Kingdom | 362/118 |
| 2273268 | 6/1994 | United Kingdom | 362/118 |

*Primary Examiner*—Steven A. Bratlie

*Attorney, Agent, or Firm*—Morton J. Rosenberg; David I. Klein

[57] ABSTRACT

A pen with illuminating function is disclosed. The pen has a dimension as that of a general pen so that a user can easily hold the pen to write. A bulb or an LED is disposed in a pen head of the pen and an adjusting assembly is disposed in a lower pen sleeve for adjusting the position of a pen core and electrically connecting with a battery contained in an upper pen sleeve. A switch assembly is disposed in an upper end of the upper pen sleeve, whereby an adjusting button of the switch assembly is rotatable to make a conductive projecting board contact with or disengage from a conductive ring member so as to close or open a circuit and turn on or off the bulb or LED. The pen provides an illuminating effect for the user to write in a dim place while enabling the user to write without obstruction.

1 Claim, 5 Drawing Sheets

PEN WITH ILLUMINATING FUNCTION

BACKGROUND OF THE INVENTION

The present invention relates to a pen with illuminating function.

A conventional pen such as a ball-pen, fountain pen, etc. is basically composed of a pen sleeve portion and a pen core portion. When using such pen in a dim place without a light or other illuminators, a user is unable to clearly and easily write with the pen. Therefore, it has been tried to combine a small flashlight with a pen so that the flashlight can provide illuminating effect for the user without external illuminators. However, such combination will make the pen excessively large and cannot be conveniently held or carried by the user. Therefore, the user will feel obstructed when writing with such pen.

Therefore, it is necessary to provide a pen which possesses illuminating function while having small dimension, whereby a user can conveniently carry the pen and write with the pen without obstruction.

SUMMARY OF THE INVENTION

It is therefore a primary object of the present invention to provide a pen having illuminating function and small dimension. The present pen includes an adjusting assembly and a switch assembly which can be easily operated to control the turning on/off of a bulb or LED disposed in the pen so as to provide an illuminating effect for a user when necessary.

The present invention can be best understood through the following description and accompanying drawing, wherein:

DETAILED DESCRIPTION OF THE PREFERRED EMBODIMENT

Figure 1:
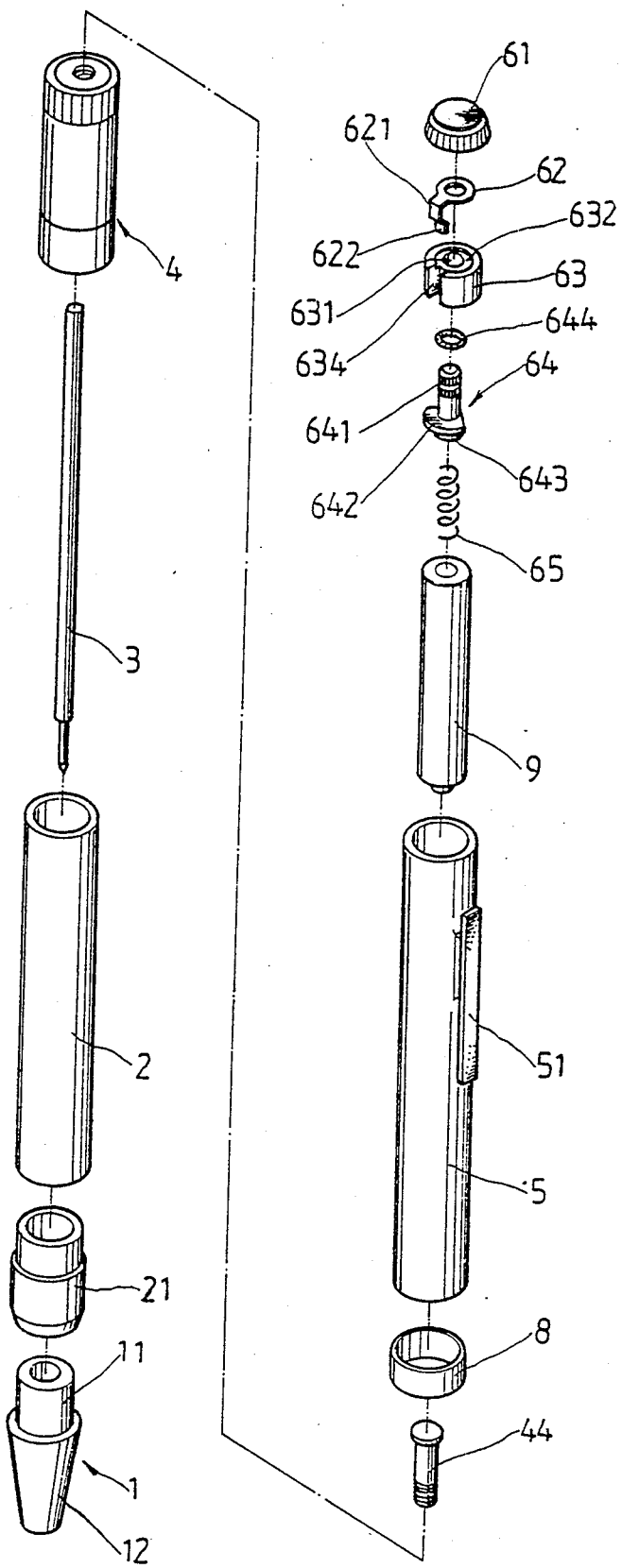
FIG. 1 is a perspective exploded view of the present invention.
Figure 2:
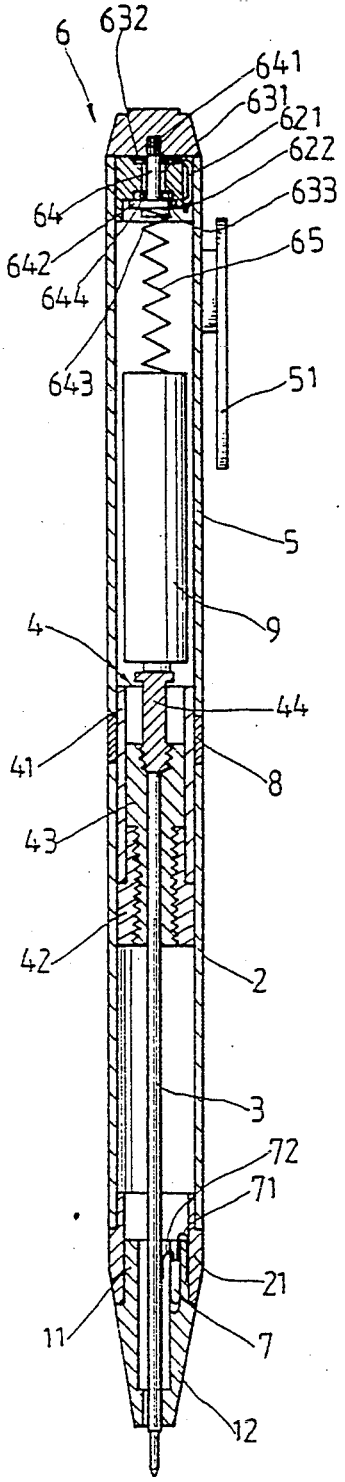
FIG. 2 is a longitudinal sectional assembled view of the present invention.
Figure 3:
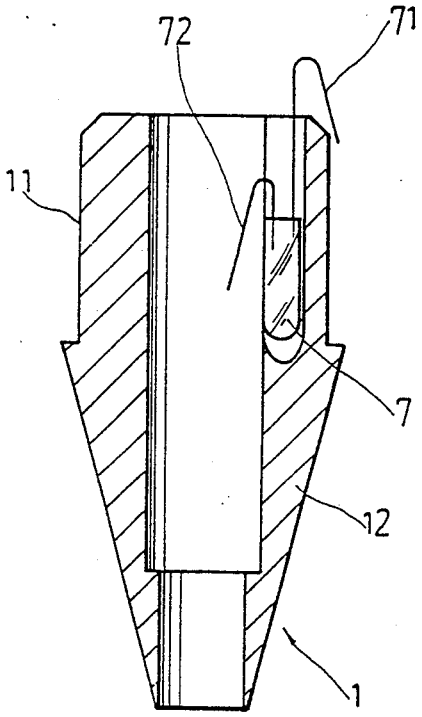
FIG. 3 is an enlarged longitudinal sectional view of the pen head of the present invention.
Figure 4:
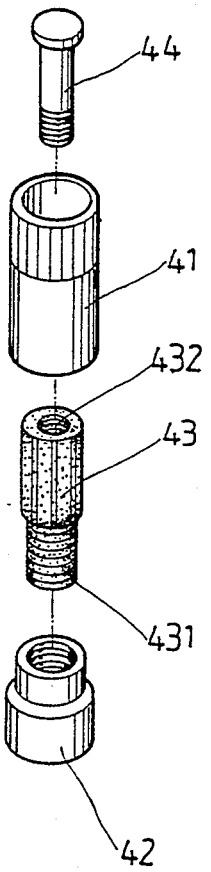
FIG. 4 is a perspective exploded view of the adjusting assembly of the present invention.

Please refer to FIGS. 1 and 2. The present invention includes a pen head 1, a lower pen sleeve 2, a pen core 3, an adjusting assembly 4, an upper pen sleeve 5 and a switch assembly. The pen head 1 is hollow and made of transparent plastic material, having an upper connecting portion 11 and a lower conic portion 12 having a stepped opening. As shown in FIG. 3, on an inner wall of the upper connecting portion 11 is formed a receptacle for receiving a bulb 7 or an LED. The bulb 7 or LED has a positive and a negative lead wires 71, 72 respectively extending outside and inside the connecting portion 11.

The lower pen sleeve 2 is metal-made, having a lower connecting portion 21 for fitting around the connecting portion 11 of the pen head 1 and electrically contacting with the positive lead wire 71 of the bulb 7 or LED. The pen core 3 passes through the lower pen sleeve 2, having a tip portion protruding outside the opening of the pen head 1. The pen core 3 is also metal-made and contacts with the negative lead wire 72 of the bulb 7 or LED.

The adjusting assembly 4 includes a sleeve member 41 having a lower portion fitted into an upper end of the lower pen sleeve 2, a stepped ring member 42 having inner thread and inserted in a lower end of the sleeve member 41 and a stepped hollow insulative member 43 formed with lower outer thread 431 screwed on the inner thread of the ring member 42 and movably fitted in the sleeve member 41. The insulative member 43 is further formed with upper inner thread 432, whereby a bolt member 44 having lower outer thread can be screwed into the upper inner thread 432 of the insulative member 43. The pen core 3 extends through the lower pen sleeve 2 and the insulative member 43 into a lower end of the bolt member 44.

The upper pen sleeve 5 is also metal-made and provided with a clip member 51. A lower end of the upper pen sleeve 5 is snugly fitted around an upper portion of the sleeve member 41 of the adjusting assembly 4. A decorative ring 8 can be fitted around the sleeve member 41 at an adjoining portion between the upper pen sleeve 5 and the lower pen sleeve 2. Referring to FIG. 2, A battery 9 is contained in the upper pen sleeve 5 and a lower end of the battery 9 contacts with a top end of the bolt member 44 of the adjusting assembly 4.

Figure 6:
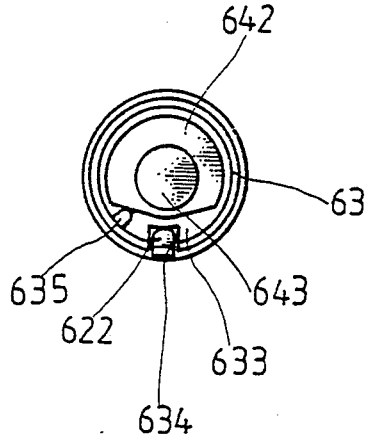
FIG. 6 is a view showing that the conductive projecting board does not contact with the conductive ring member to open the circuit.

The switch assembly 6 includes an adjusting button 61, a conductive ring member 62, a casing member 63, a metal rod member 64 and a spring 65. A hole (not shown) is formed on a bottom face of the adjusting button 61. The casing member 63 is fitted in the upper pen sleeve 5, having a central through hole 631. An upper and a lower stepped recesses 632, 633 are formed at an upper and a lower end of the through hole 631. A lengthwise groove 634 is formed on a lateral side of the casing member 63 for locating the conductive ring member 62 therein. A strip-like projection 635 is disposed on a lateral side of the lower recess 633 near the groove 634 as shown in FIG. 6. The conductive ring member 62 has a top ring section, a contact section 621 outward extending from a lateral side of the ring section and a conductive end 622 downward extending from the contact section 621 and inward bent. The conductive ring member 62 is disposed in the upper recess 632 of the casing member 63 with the contact section 621 passing through and protruding outside the groove 634 of the casing member 63. After the casing member 63 is positioned into the upper pen sleeve 5, the contact section 621 of the conductive ring member 62 contacts with the upper pen sleeve 5. The metal rod member 64 has a conic end and a dented projection 641 beside the conic end. The other end of the rod member 64 is formed with a flange section 643 and a conductive projecting board 642 near a top of the flange section 643. The metal rod member 64 is assembled in such a manner that a rubber washer 644 is first fitted with the rod member 64 and then the rod member 64 passes through the hole 631 of the casing member 63 and the conductive ring member 62. Then the dented projection 641 of the rod member 64 is forced into and located in the hole of the bottom face of the adjusting button 61. When the adjusting button 61, conductive ring member 62, casing member 63, rubber washer 644 and the metal rod member 64 are assembled and fitted into the upper pen sleeve 5, the spring 65 is received in the upper pen sleeve 5 with an upper end contacting with the flange section 643 of the metal rod member 64 and a lower end contacting with the battery 9.

Figure 5:
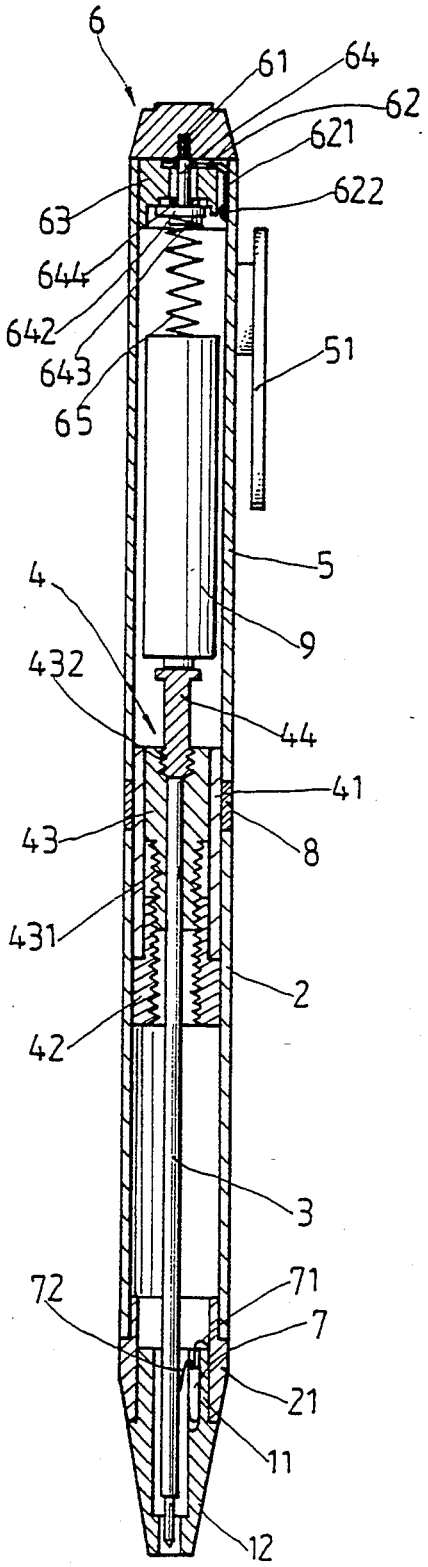
FIG. 5 is a view according to FIG. 2, showing the adjustment of the pen core.
Figure 7:
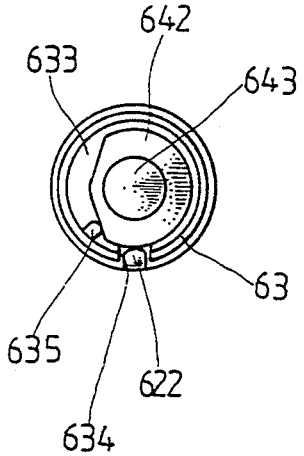
FIG. 7 is a view showing that the conductive projecting board contacts with the conductive ring member to close the circuit.

Referring to FIGS. 2 and 5, after assembled, the hollow insulative member 43 of the adjusting assembly 4 can be axially moved back and forth as will be described hereinafter. When the pen core 3 is adjusted to extend outside the pen head 1 or retracted thereinto, the insulative member 43 is moved along with the bolt member 44 locked therewith. The upper end of the pen core 3 is fitted into and abuts against the bolt member 44, so that the movement of the insulative member 43 will lead to the extending/retracting movement of the pen core 3. FIG. 5 shows that the insulative member 43 is moved upward to retract the pen core 3. The extending/retracting movement of the pen core 3 will lead to the extension/compression of the spring 65. However, the spring 65 will always contact between the flange section of the metal rod member 64 and the battery 9 for electrically connecting the battery 9 with the negative lead wire 72 of the bulb 7 or the LED. The switch assembly 6 serves to control the on/off state of the bulb 7 or LED. The contact section 621 of the conductive ring member 62 mounted on the casing member 63 always contacts with the upper pen sleeve 5, whereby when the adjusting button 61 is not used to rotate the conductive projecting board 642 to contact with the conductive end 622 of the conductive ring member 62, the upper end of the battery 9 is not electrically connected with the positive lead wire 71 of the bulb 7 or LED as shown in FIG. 6. However, when the adjusting button 61 is used to rotate the conductive projecting board 642 to contact with the conductive end 622 of the conductive ring member 62 as shown in FIG. 7, the upper end of the battery 9 is electrically connected with the positive lead wire 71 of the bulb 7 or LED through the spring 65, metal rod member 64, conductive ring member 62 and upper and lower pen sleeves 5, 2. At this time, the bulb 7 or the LED is turned on. The strip-like projection 635 of the casing member 63 serves to reliably locate the conductive projecting board 642 at a turning on or a turning off position.

Please refer to FIGS. 2 and 5 which show the movement of the hollow insulative member 43. The upper end of the sleeve member 41 is snugly fitted in the upper pen sleeve 5 so that when the upper pen sleeve 5 is rotated, the sleeve member 41 will be rotated. (The lower end of the sleeve member 41 is snugly fitted in the lower pen sleeve 2.) The lower end of the sleeve member 41 is secured with a ring member 42 in which the hollow insulative member 43 is screwed. Therefore, when the sleeve member 41 along with the ring member 42 is rotated, the insulative member 43 will move axially to adjust the position of the pen core 3. The rubber washer 644 in the adjusting button 61 serves to smoothen the rotation of the adjusting button 61. The conductive ring member 62 of the switch assembly 6 cooperates with the conductive projecting board 642 to control the opening/closing of the circuit.

It is to be understood that the above description and drawings are only used for illustrating one embodiment of the present invention, not intended to limit the scope thereof. Any variation and derivation from the above description and drawings should be included in the scope of the present invention.

What is claimed is:

1. A pen with illuminating function, comprising:

a pen head having an upper connecting portion and a lower conic portion having a stepped opening, on an inner wall of the upper connecting portion being formed a receptacle for receiving a bulb or an LED, the bulb or LED having a positive and a negative lead wires respectively extending outside and inside the connecting portion;

a lower pen sleeve which is metal-made, having a lower connecting portion for fitting around the connecting portion of the pen head and electrically contacting with the positive lead wire of the bulb or LED;

a pen core passing through the lower pen sleeve and pen head and having a tip portion protruding outside the opening of the pen head, the pen core being metal-made and contacting with the negative lead wire of the bulb or LED;

an adjusting assembly including a sleeve member having a lower portion fitted into an upper end of the lower pen sleeve, a stepped ring member having inner thread and inserted in a lower end of the sleeve member and a stepped hollow insulative member formed with lower outer thread screwed on the inner thread of the ring member and movably fitted in the sleeve member, an upper end of the insulative member being connected with a lower end of a bolt member, whereby the pen core extends through the lower pen sleeve and the insulative member into the lower end of the bolt member;

an upper pen sleeve which is metal-made and has a lower end snugly fitted around an upper portion of the sleeve member of the adjusting assembly, a battery being contained in the upper pen sleeve and a lower end of the battery contacting with a top end of the bolt member of the adjusting assembly; and a switch assembly including an adjusting button, a conductive ring member, a casing member, a metal rod member and a spring, a hole being formed on a bottom face of the adjusting button, the casing member being fitted in the upper pen sleeve and having a central through hole, an upper and a lower stepped recesses being formed at an upper and a lower end of the through hole, a lengthwise groove being formed on a lateral side of the casing member for locating the conductive ring member therein, a strip-like projection being disposed on a lateral side of the lower recess near the groove, the conductive ring member having a top ring section, a contact section outward extending from a lateral side of the ring section and a conductive end downward extending from the contact section and inward bent, the conductive ring member being disposed in the upper recess of the casing member with the contact section passing through and protruding outside the groove of the casing member, whereby after the casing member is positioned into the upper pen sleeve, the contact section of the conductive ring member contacts with the upper pen sleeve, the metal rod member having a conic end and a dented projection beside the conic end, the other end of the rod member being formed with a flange section and a conductive projecting board near a top of the flange section, the metal rod member being assembled in such a manner that a rubber washer is first fitted with the rod member and then the rod member passes through the hole of the casing member and the conductive ring member, and then the dented projection of the rod member is forced into and located in the hole of the bottom face of the adjusting button, the spring being received in the upper pen sleeve with an upper end contacting with the flange section of the metal rod member and a lower end contacting with the battery, whereby when the upper pen sleeve is rotated, the pen core is adjusted to extend outside or retract into the pen head, and when the adjusting button is rotated, the conductive projecting board of the switch assembly is rotated to contact with or disengage from the conductive end of the conductive ring member so as to turn on or off the bulb or LED.

* * * * *